US005829413A

United States Patent [19]

Rodriguez-Amaya

[11] Patent Number: 5,829,413

[45] Date of Patent: Nov. 3, 1998

[54] FUEL INJECTION DEVICE

[75] Inventor: Nestor Rodriguez-Amaya, Stuttgart, Germany

[73] Assignee: Robert Bosch GmbH, Stuttgart, Germany

[21] Appl. No.: 981,383

[22] PCT Filed: Dec. 11, 1996

[86] PCT No.: PCT/DE96/02380

§ 371 Date: Dec. 22, 1997

§ 102(e) Date: Dec. 22, 1997

[87] PCT Pub. No.: WO97/40272

PCT Pub. Date: Oct. 30, 1997

[30] Foreign Application Priority Data

Apr. 23, 1996 [DE] Germany ..... 196 16 084.7

[51] Int. Cl.[6] ..... F02M 51/06

[52] U.S. Cl. ..... 123/506; 251/54

[58] Field of Search ..... 251/54, 129.15; 123/450, 458, 506

[56] References Cited

U.S. PATENT DOCUMENTS 5,186,151 2/1993 Schwerdt et al. ..... 251/54

5,478,045 12/1995 Ausman et al. ..... 251/54

*Primary Examiner*—Thomas N. Moulis

*Attorney, Agent, or Firm*—Edwin E. Greigg; Ronald E. Greigg

[57] ABSTRACT

A fuel injection device which has a solenoid valve whose valve member is provided with a solenoid plunger on an end, whose operational movement is damped by means of a damping device which is comprised of a damping chamber defined by the solenoid plunger, and the chamber is discharged via a throttle into a discharge chamber.

13 Claims, 1 Drawing Sheet

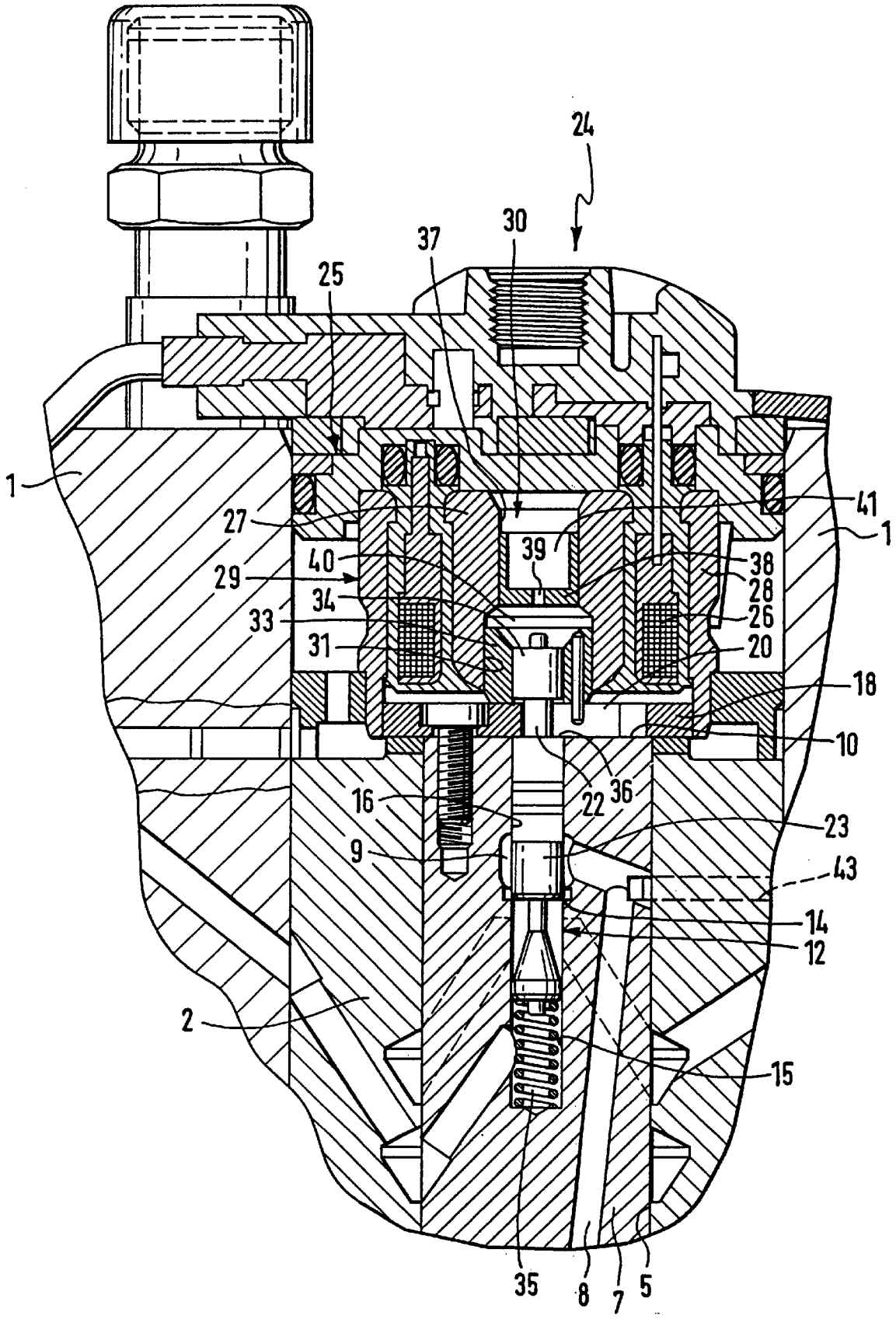
24
30
37
25
1
41
1
27
39
40
38
29
28
34
26
33
20
31
18
10
36
22
16
23
9
43
14
12
2
15
35
8
7
5

FUEL INJECTION DEVICE

PRIOR ART

The invention is based on a fuel injection device EP-B1-0 195 261 has disclosed a fuel injection device of this kind in which a solenoid valve is provided that has a flat armature which brings the valve member into the closed position counter to the force of an opening spring when the electromagnet is excited. This happens in a undamped manner. When the magnet is not excited, the spring of the solenoid valve moves the armature in the opening direction of the solenoid valve. Only upon reaching its end position does the armature enclose the damping chamber, whose containing walls simultaneously represent the opening simultaneously represent the opening limitation stop of the valve member of the solenoid valve. The damping is carried out chiefly by means of the approach of the flat armature toward the damping chamber and the damping is limited to the last part of the valve opening stroke. The known valve is provided in a valve housing which is installed in a stationary fashion in a fuel injection pump.

ADVANTAGES OF THE INVENTION

The fuel injection device according to the invention has the advantage over the prior art that a damping is continuously effective over the entire stroke of the valve member of the solenoid valve and a small solenoid plunger is used, which has a low mobile mass. This results in a small size and a rapid response behavior of the solenoid valve.

The advantageous improvement results in a structurally very simple embodiment which incorporates the throttle that controls the damping behavior. In a particularly advantageous manner, a throttle of this kind can also be exchanged and the replacement part can also be used to set different throttling and damping effects. In the advantageous improvement, the position of the throttle and with it the volume of the damping chamber can be adjusted by means of pressing the insert piece more or less deeply into the recess and in turn, the dynamic behavior of the throttle effect can thus be controlled.

The improvement results in an optimal configuration of the magnet circuit of the electromagnet and moreover also in a simple realization of a stroke stop for the opening stroke of the valve member.

Finally, the embodiment results in the very advantageous possibility of associating a solenoid valve with a rotating part. It is furthermore advantageous to use fluid already present in the form of fuel as a damping fluid.

BRIEF DESCRIPTION OF THE DRAWING

A partial cross sectional view of an exemplary embodiment of the invention is depicted in the drawing and is explained in detail in the subsequent description.

DETAILED DESCRIPTION

The section of the drawing shows a part of a distributing injection pump as a fuel injection device in which the features essential to the invention are realized. A bush 2 is inserted into a housing 1 of the fuel injection pump and on its interior has in turn a guide bore 5 in which a distributor 7 is guided. This distributor is driven to rotate by means, not shown, and rotates synchronously with the speed of an associated internal combustion engine. It is axially secured against movement in the housing 1 and has a longitudinal conduit 8 which on the one end, communicates with a pump work chamber not shown in detail here and on the other end, feeds into a pressure chamber 9, which is part of a conduit 12 that ends blindly, leads from one end face 10 of the distributor, and is disposed coaxial to the axis of the distributor. The pressure chamber is defined on the one end by a valve seat 14 which transitions into a continuing partial bore 15 of the conduit 12 on the discharge end. The other end of the pressure chamber 9 is adjoined by a coaxial guide bore 16 that emerges from the end face 10 of the distributor.

This is screwed into a magnetic disk 18 and has a keyhole-shaped recess 20. A neck 22 of a valve member 23 of a solenoid valve 24 protrudes through this recess 20 into a narrow part disposed coaxial to the axis of the distributor. This solenoid valve 24 is inserted with its housing 25 into a recess in the housing 1 of the fuel injection pump and is fixed there in a stationary fashion. In its housing 25, the solenoid valve has an electromagnet 29 that has a magnet coil 26 which is disposed inside a magnet core that has the shape of an annular cup with a central, sleeve-shaped magnet core 27 and a magnet outer jacket 28, and the magnet coil is supported between this outer jacket and the central magnet core. On the end face toward the distributor, the magnet core is supplemented by means of the magnet disk 18, which is adapted in diameter to the inner diameter of the magnet outer jacket and constitutes only a narrow air gap in relation to it. As a result, this allows for the fact that when the electromagnet 29 is stationary, the magnet disk 18, which is part of the magnet circuit, can turn together with the rotating distributor 7.

The central magnet core 27 has a recess 30 passing through it that is embodied as a stepped through bore of which a part 31 that is larger in diameter is embodied as a circular cylinder and serves to guide a solenoid plunger 33. This plunger is attached to a cup-shaped end 34 adjoining the neck 22 of the valve member 23 and when the magnet coil is excited, actuates the valve member in the closing direction toward its seat 14. A compression spring 35 that is supported in the part of the bore 15 acts on the valve member in the opening direction. The armature can also be of one piece that simultaneously constitutes the cup-shaped end 34 of the valve member 23.

The stroke of the valve member is defined by the contact of a shoulder 36 of the valve member against the magnet disk. The shoulder is formed by the point at which the part of the valve closing member 23 that slides in the guide bore 16 transitions into the neck 22.

An insert piece 38, which is embodied as essentially cup-shaped, is pressed into the part 37 of the stepped through bore 30 that is smaller in diameter, with its bottom pointing toward the solenoid plunger 33 and a throttle in the form of a bore 39 is let into the center of its bottom. This connects a damping chamber 40, which is enclosed in the diametrically larger part 31 of the stepped through bore between the insert piece and the solenoid plunger 33, to a discharge chamber 41 that adjoins the insert piece on the other side and is connected with fuel carrying spaces of the fuel injection pump.

The insert piece can be pressed different distances into the diametrically smaller part 37 of the stepped through bore 30 and consequently, the volume of the damping chamber 40 can be adjusted. The insert piece can be provided with a necessary throttle cross section that corresponds to the intended use and can also be exchanged if necessary.

In the operation of the fuel injection device, the valve member 23 is acted upon in the opening direction by the compression spring 35 so that the valve member is lifted up from its valve seat 14 and the pressure chamber 9 can be relieved to the discharge side. In this position of the solenoid valve, high pressure cannot build up in the pump work chamber, not shown, and correspondingly, high pressure also cannot be conducted to a fuel injection valve via one of several supply lines 43 that alternatingly communicate with the pressure chamber 9 or the pressure conduit 8 as the distributor rotates. When the magnet coil is supplied with power, a magnetic flux is produced that moves the solenoid plunger 33 toward the magnet disk 18 until the valve member comes into contact with its valve seat 14. The stroke in the opening direction, as previously explained, is defined by means of the contact of the shoulder 36 against the magnet disk. The keyhole-shaped embodiment of the recess 20 permits the guidance of the head 34 through the magnet disk 18. In a known manner, the head of the valve member is guided through an eccentrically disposed wider diameter and then the neck 22 is positioned in the coaxial position in relation to the distributor axis.

The fuel injection device described above and the associated solenoid valve achieves an exact fuel quantity metering, in particular in the instance provided here, in which with the aid of the solenoid valve, the high pressure delivery phase is determined with the injection onset and injection duration of the fuel injection pump. Via a respective supply line 43, the rotating distributor triggers the associated fuel injection valve and supplies it with the high pressure injection quantity controlled by the solenoid valve. With a lower mass, the valve functions very rapidly and in a vibration-free manner, with the optimally adaptable damping provided here.

The foregoing relates to preferred exemplary embodiments of the invention, it being understood that other variants and embodiments thereof are possible within the spirit and scope of the invention, the latter being defined by the appended claims.

I claim:

1. A fuel injection device that has a solenoid valve (24) for controlling fuel flows, with a valve member (23) that is actuated by means of an armature (33) of the electromagnet (29) of the solenoid valve, said armature cooperates with a magnet core (27, 28, 18) of a magnet coil (26) of the electromagnet and in at least one of its positions, encloses a damping chamber (40) in the electromagnet (29), said damping chamber continuously communicates with a discharge chamber (41) via a damping throttle (39), the armature (33) is embodied as cylindrical and, as a solenoid plunger, continuously dips into a cylindrical recess (30) that contains the damping chamber (40) in the magnet core (27) of the electromagnet.

2. A fuel injection device according to claim 1, in which the recess (30) is embodied as a coaxial through bore in a central magnet core (27) of the electromagnet (29), which core passes axially through the magnet coil (26), and the throttle (39) is embodied in an insert piece (38) that closes the recess (30) off in relation to the discharge chamber (41).

3. A fuel injection device according to claim 2, in which the insert piece (38) is embodied as cup-shaped and is pressed into the recess (30, 37).

4. A fuel injection device according to claim 2, in which the armature (33) is disposed on a head (34) of a valve member (23) of the solenoid valve (24) and between this head and a part of the valve member that is sealingly guided in a guide bore (16), a neck (22) is provided, said neck has a reduced diameter and is guided through an opening (20) in a disk (18) that is disposed in the magnet circuit of the electromagnet (29) and has an opening for guiding the diametrically larger head (34) of the valve member (23), which opening, adjacent to the region through which the neck (22) passes in the assembled state, has a keyhole-shaped enlarged part and serves as a stop for the valve member (23), which is acted on by a spring.

5. A fuel injection device according to claim 3, in which the armature (33) is disposed on a head (34) of a valve member (23) of the solenoid valve (24) and between this head and a part of the valve member that is sealingly guided in a guide bore (16), a neck (22) is provided, said neck has a reduced diameter and is guided through an opening (20) in a disk (18) that is disposed in the magnet circuit of the electromagnet (29) and has an opening for guiding the diametrically larger head (34) of the valve member (23), which opening, adjacent to the region through which the neck (22) passes in the assembled state, has a keyhole-shaped enlarged part and serves as a stop for the valve member (23), which is acted on by a spring.

6. A fuel injection device according to claim 4, in which the electromagnet (29) of the solenoid valve (24) is disposed in a stationary fashion in the fuel injection device, that the disk (18) is attached to an end face (10) of a rotationally driven distributor (7) of the fuel injection device and, with a small air gap, radially adjoins a jacket part (28) of the magnet core of the electromagnet, and that the valve member (23) dips into the guide bore (16) in the distributor (7), and said guide bore is coaxial to the axis of the distributor (7).

7. A fuel injection device according to claim 5, in which the electromagnet (29) of the solenoid valve (24) is disposed in a stationary fashion in the fuel injection device, that the disk (18) is attached to an end face (10) of a rotationally driven distributor (7) of the fuel injection device and, with a small air gap, radially adjoins a jacket part (28) of the magnet core of the electromagnet, and that the valve member (23) dips into the guide bore (16) in the distributor (7), and said guide bore is coaxial to the axis of the distributor (7).

8. A fuel injection device according to claim 2, in which fuel that acts as a damping fluid flows through the electromagnet (29).

9. A fuel injection device according to claim 3, in which fuel that acts as a damping fluid flows through the electromagnet (29).

10. A fuel injection device according to claim 4, in which fuel that acts as a damping fluid flows through the electromagnet (29).

11. A fuel injection device according to claim 5, in which fuel that acts as a damping fluid flows through the electromagnet (29).

12. A fuel injection device according to claim 6, in which fuel that acts as a damping fluid flows through the electromagnet (29).

13. A fuel injection device according to claim 7, in which fuel that acts as a damping fluid flows through the electromagnet (29).

* * * * *